United States Patent [19]

Song

[11] Patent Number: 4,675,478

[45] Date of Patent: Jun. 23, 1987

[54] ELECTRIC POWER CONTROL SWITCH

[75] Inventor: Ki W. Song, Suwon, Rep. of Korea

[73] Assignee: Kookje Elec. Ind. Co., Ltd., Rep. of Korea

[21] Appl. No.: 798,742

[22] Filed: Nov. 15, 1985

[30] Foreign Application Priority Data

Nov. 17, 1984 [KR] Rep. of Korea ..... 11632/1984

[51] Int. Cl.[4] ..... H01H 43/10

[52] U.S. Cl. ..... 200/38 R; 200/38 F; 200/38 FA

[58] Field of Search ..... 200/35 R, 36, 37 R, 200/37 A, 38 R, 38 A, 38 F, 38 FA, 38 B, 38 C, 39 R, 39 A; 307/141, 141.8

[56] References Cited

U.S. PATENT DOCUMENTS 3,385,972 5/1968 Bement ..... 307/141 X 3,610,848 10/1971 Rosenberg ..... 200/38 B 4,551,589 11/1985 Bowling ..... 200/38 A

*Primary Examiner*—J. R. Scott

*Attorney, Agent, or Firm*—Ostrolenk, Faber, Gerb & Soffen

[57] ABSTRACT

The electric power control switch of the present invention includes a plurality of contact assemblies which are repeatedly opened and closed by a motor driven timing cam and two manually operated control cams. The control cams also control the position of associated operating levers which cooperate with additional plural contact assemblies. The relationship of the motor driven timing cam, manually operated control cams and operating levers provides an unique switching arrangement whereby the period for operation of an oven, range or other electrical appliance is widely varied and switch contact life is enhanced.

8 Claims, 14 Drawing Figures

FIG, 2
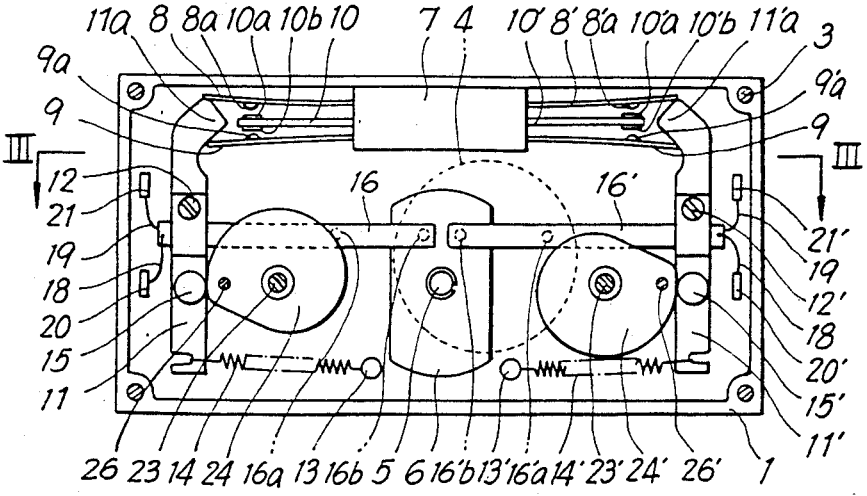
FIG, 3
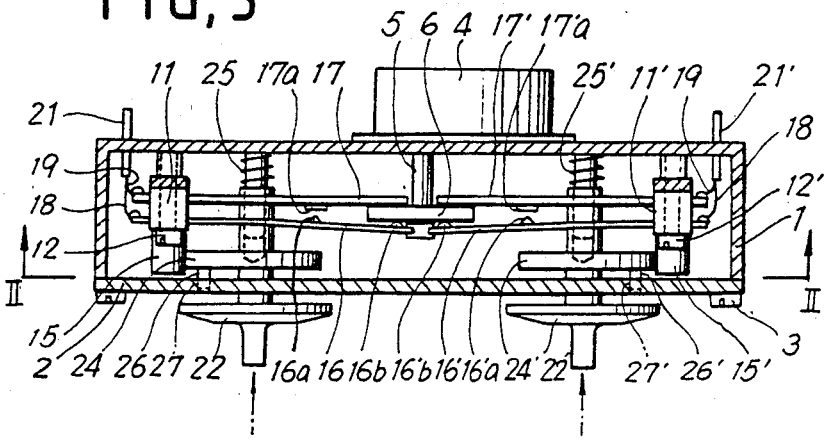

FIG, 4
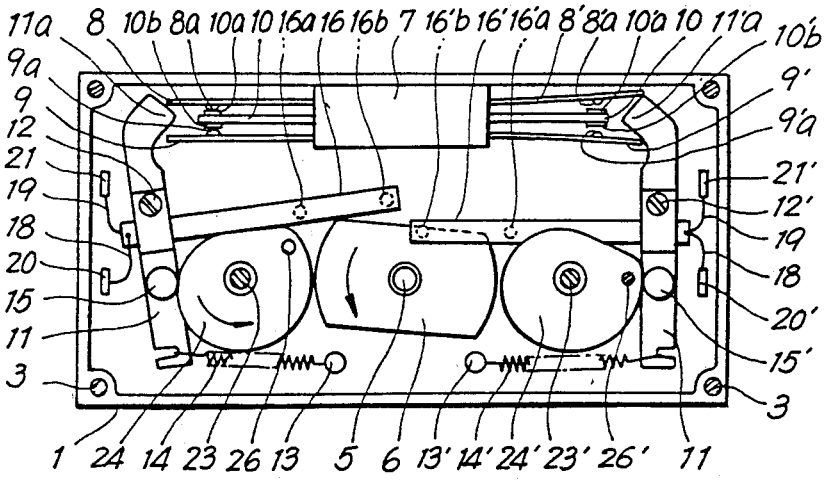
FIG, 5
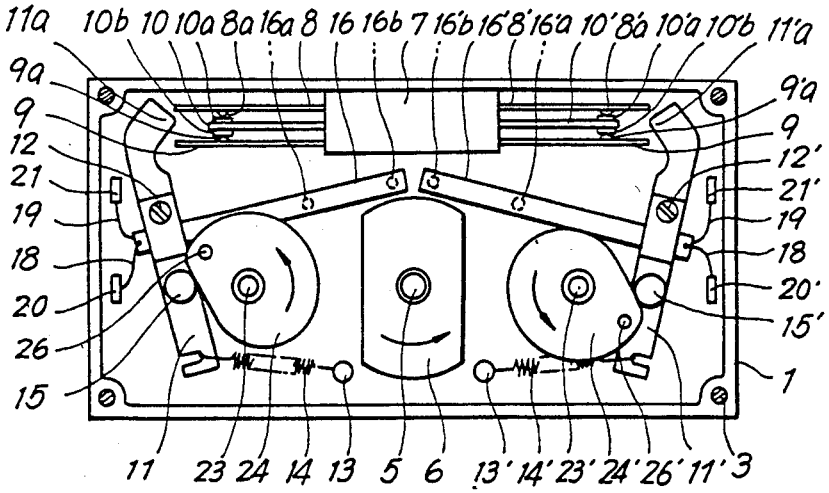

FIG,6A FIG,6B FIG,6C FIG,6D
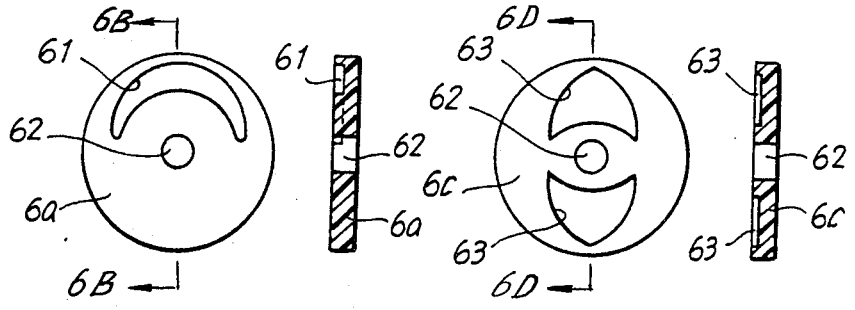
FIG,6E FIG,6F FIG,6G FIG,6H
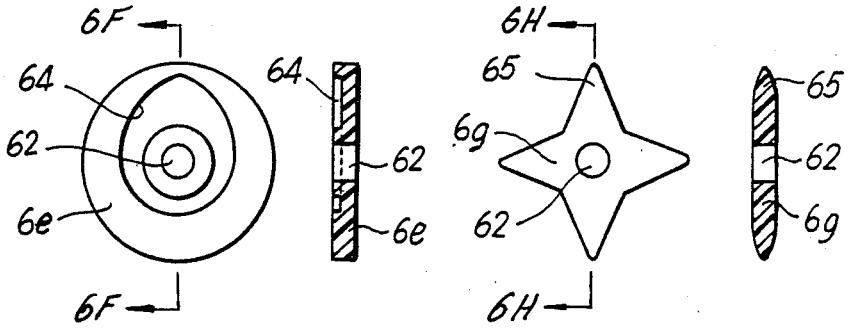

FIG,7
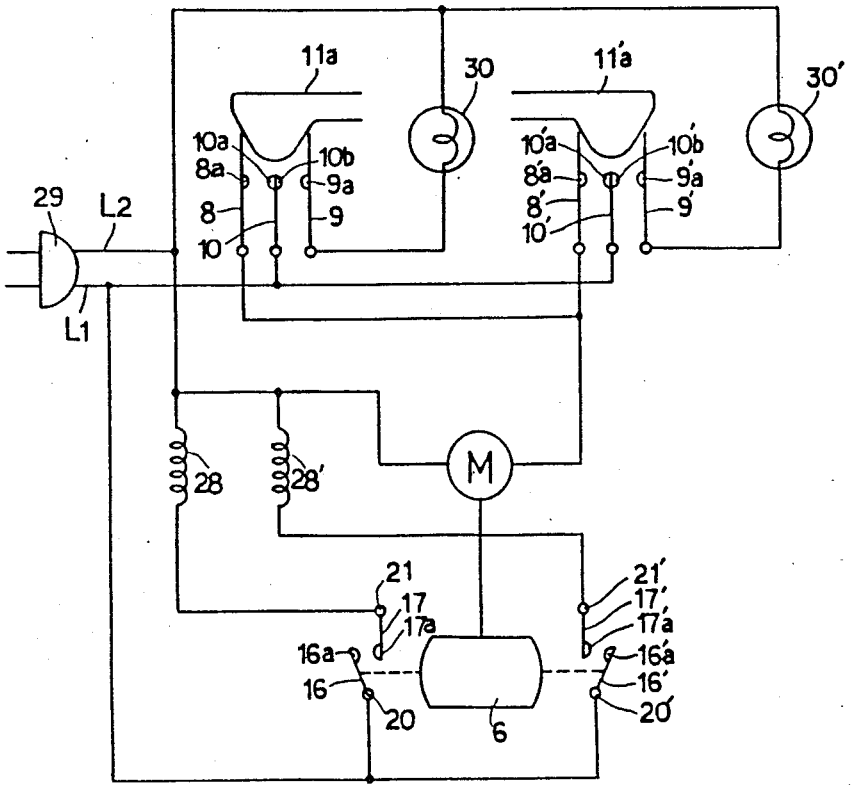

ELECTRIC POWER CONTROL SWITCH

BACKGROUND OF THE INVENTION

1. Field of the Invention

The present invention relates to an electric power control switch, and, in particular, to a variable electric power control switch for controlling electric power by varying the application time of current to an electric load in electric heating equipment such as an electric range or an electric oven.

2. Description of the Prior Art

Generally, an electric heating equipment comprising one or more electric heating units, such as an electric range or an electric oven, includes an electric power control switch adapted to control the heating temperature of each heating unit, depending upon the desire of the user.

The heating temperature of a heating unit can be regulated by controlling the electric power applied to the heating unit, that is, the application time of current thereto.

Conventionally, a device utilizing a bimetal, a so called "infinite switch", has been used as an electric power switch of the above-mentioned type wherein the temperature of heating unit is constantly regulated by varying the application time of current to the heating unit. Such an infinite switch utilizes a bimetal including a heater, so that contacts on the bimetal repeat ON and OFF conditions in accordance with the heating temperture of the heater. In this arrangement, the period of repeating ON and OFF conditions of the contacts greatly varies due to the variation of temperature around the bimetal, so that the operater can not control constantly and accurately the electric power as desired. In view of the fact that in this switch contacts change ON and OFF conditions thereof, depending upon expanded and contracted deformation of bimetal, opening and closing of contacts can not be effected in a moment. Furthermore, severe spark is generated in the opening and closing of contacts, thereby causing contacts to be severely worn. After being used for a long time, the gap between contacts varies due to the wearing of contacts, so that the period of opening and closing the switch varies, thereby causing the accuracy of the switch to be decreased. The moveable member of the switch has to be made of expensive material having high elasticity, in order to maintain sufficient gap between contacts to prevent the generation of spark in opening of contacts. In addition, the elastic fatigue of the moveable member is increased due to the large deformation of said moveable member, thereby causing the life of the switch to be shortened.

Other than the above-mentioned infinite switch utilizing a bimetal, there is an electric power control switch wherein a contoured cam driven by a motor serves to periodically urge a moveable contact blade against a fixed contact blade, in order to open and close contacts on said blades, respectively. For example, a defrost timer for a refrigerator, a timer for a washing machine, or a rhythm timer for a motor fan have been known as the above-mentioned type of electric power control switch. In such motor-driven switch, an overload is repeatedly subjected to the moveable contact blade, thereby causing the life of the switch to be shortened. As in the case of the infinite switch, there is a problem of severe wearing of contacts caused by a generation of spark between contacts, so that the period of repeating ON and OFF conditions of contacts greatly varies, thereby causing the accuracy of the switch to be lowered.

SUMMARY OF THE INVENTION

Accordingly, an object of the present invention is to provide an electric power control switch eliminating the above-mentioned disadvantages encountered in the prior art.

The other object of the present invention is to provide an electric power control switch enabling contacts to be opened and closed in a moment by passing a timing cam driven by a motor between contact members, thereby causing the generation of spark and thus the wearing of contacts to be reduced, as well as enabling the life of contact members to be lengthened due to a reduced load applied thereto, whereby the period of opening and closing the switch is maintained essentially constant, even when contacts are worn, thereby enabling the accuracy of switch to be increased.

Another object of the present invention is to provide an electric power control switch wherein electric power supplied to two electric loads can be controlled independently by one motor, and the period of opening and closing contacts can be varied by a simple operation of the operator.

In accordance with the present invention, these objects are accomplished by providing an electric power control switch constructed as described hereinafter.

The electric power control switch of present invention comprises a switch housing removeably carrying a cover plate at the front surface thereof. To the rear surface of the housing, a reduction device is attached, which carries a synchronous motor therein. The reduction device includes a rotary shaft extending into the interior of the housing. At the extended end of the rotary shaft, a timing cam which is able to control the period of closing and opening the switch is mounted to rotate according to the rotation of rotary shaft. At the inside-upper portion of the housing, a first switch means is disposed to close and open an electric power supply circuit of the motor.

In accordance with the present invention, the first switch means comprises a switch holder, a pair of first moveable contact members extending in parallel with each other at each side of said holder and each having one end fixed to said holder and the other end forming a free end, and a first fixed contact member extending in parallel with said moveable contact members and between the moveable contact members. Below the first switch means, an operating lever is vertically arranged to move to a position closing or opening the first switch means by the operation of a control cam positioned at a desired position. The operating lever carries a second switch means for closing and opening an electric circuit of an electric load in electric heating equipment.

The second switch means comprises a second moveable contact member and a second fixed contact member extending in parallel with the second moveable contact member. Each contact member of the second switch means has one end fixed to the operating lever and the other end forming a free end extended into the rotation track of timing cam. The timing cam is arranged to pass between the second moveable contact member and the second fixed contact member. When the timing cam passes between these contact members, contacts of these contact members are maintained at opened condition thereof. When the timing cam escapes from these contact members, contacts of the contact members are maintained at closed condition thereof. Thus, the second switch means is closed and opened at certain intervals predetermined by the timing cam.

In the above-mentioned arrangement of electric power control switch, the period of closing and opening the switch for an electric load can be variously controlled depending upon the shape and construction of the timing cam. When the setting position of the control cam changes, the position of the second switch means changes with respect to the timing cam, thereby enabling the period of closing and opening the second switch means to be widely controlled.

In the electric power control switch of the present invention, particularly, the timing cam passes between two contact members extending in parallel with each other, thereby enabling the closing and opening of contacts to be effected in a moment. Thereby, it is possible to reduce the generation of spark and thus the wearing of contacts. In addition, the life of contact members is lengthened, by virtue of a reduced load applied to contact members.

BRIEF DESCRIPTION OF THE DRAWINGS

Other objects and advantages of the present invention will be apparent from the following descriptions taken in conjunction with the accompanying drawings.

FIG. 2 is a front view taken in the direction of the arrows along the line II—II of FIG. 3, the cover plate being broken away from the switch;

FIG. 3 is a cross-sectional view taken along the line III—III of FIG. 2.

FIG. 4 is a front view similar to FIG. 2 showing an operating condition of the switch of FIGS. 1 to 3;

FIG. 5 is a front view similar to FIG. 2, showing another operating condition of the switch of FIGS. 1 to 3;

FIG. 6A is a plan view of a second embodiment of a timing cam utilized in the electric power switch;

FIG. 6B is a cross-sectional view taken through line 6B—6B of FIG. 6A;

FIG. 6C is a plan view of a third embodiment of a timing cam;

FIG. 6D is a cross-sectional view taken through line 6D—6D of FIG. 6C;

FIG. 6E is a plan view of a fourth embodiment of a timing cam;

FIG. 6F is a cross-sectional view taken through line 6F—6F of FIG. 6E.

FIG. 6G is a plan view of a fifth embodiment of a timing cam;

FIG. 6H is a cross-sectional view taken through line 6H—6H of FIG. 6G; and

FIG. 7 is a wiring diagram of an example of electric circuit of the switch according to the present invention.

DETAILED DESCRIPTION OF THE PREFERRED EMBODIMENTS

Figure 1:
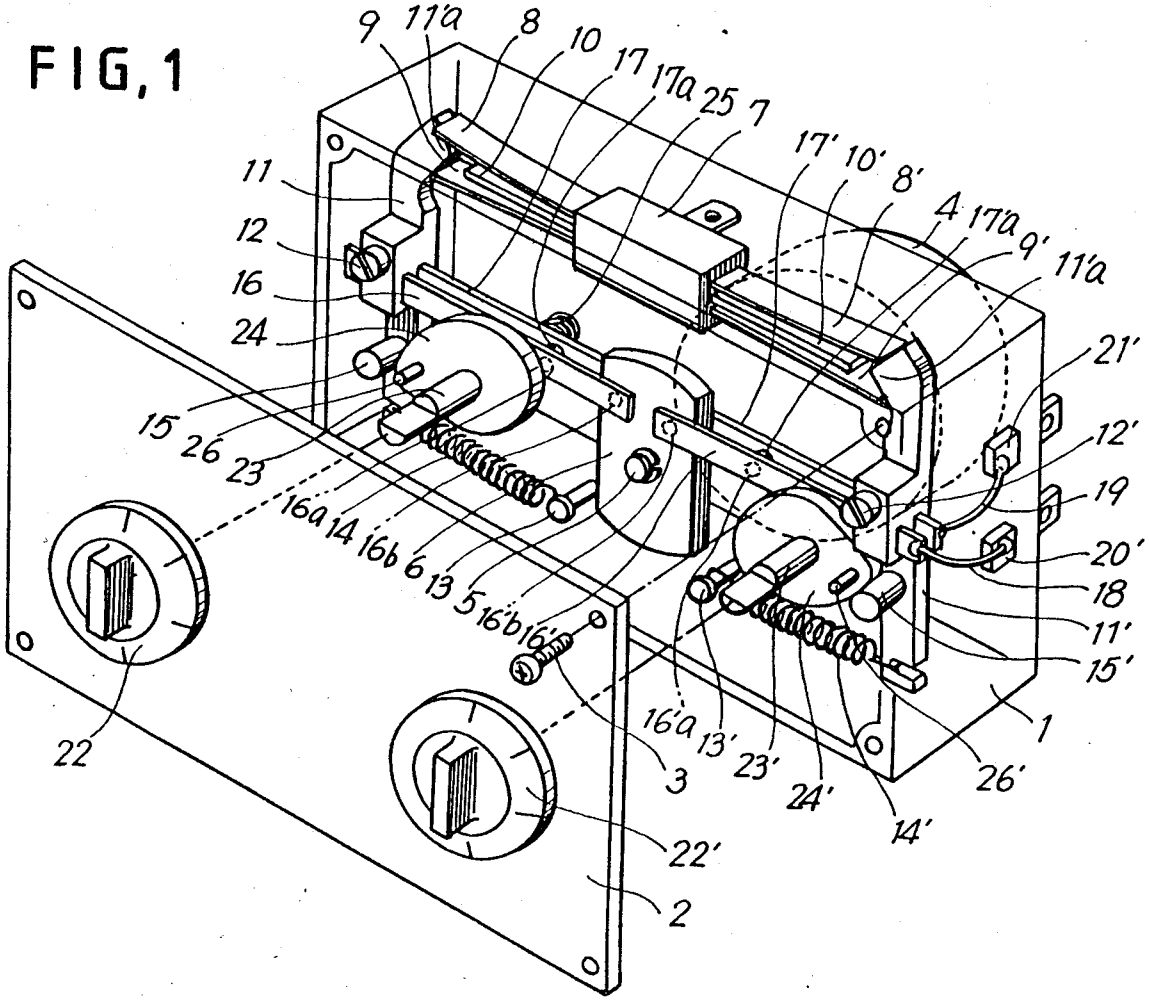
FIG. 1 is a partially exploded perspective view of an electric power control switch in accordance with a preferred embodiment of the present invention.

Referring to FIG. 1, an electric power control switch according to the present invention comprises a rectangular housing 1 made of an electric insulation material. A cover plate 2 is removeable fastened to the front face of housing 1 by means of bolts 3. To the rear face of housing 1, a reduction device 4 is attached, which carries a synchronous motor M therein. For the clarity of illustration, the motor is schematically shown only in FIG. 7. The reduction device 4 includes a rotary shaft 5 extending into an interior of the housing 1. A timing cam 6 is rigidly supported, at the central part thereof, the extended end of rotary shaft 5, to rotate according to the rotation of rotary shaft 5.

The timing cam 6 comprises a rectangular plate member having a uniform thickness.

At the middle portion of inside-upper surface of the housing 1, a switch holder 7 made of an electric insulation material is disposed. From one lateral surface of the holder 7, a pair of first moveable contact members 8 and 9 made of elastic metal pieces laterally extend in parallel with each other and with a uniform vertical space therebetween. Each first moveable contact member has one end fixed to the holder 7 and a free end opposed to the fixed end. Between the first moveable contact members 8 and 9, a first fixed contact member 10 having a shorter length than the moveable contact members is arranged to extend in parallel with the moveable members and is uniformly spaced from each moveable member. The first fixed contact member 10 also has one end fixed to the holder 7 and a free end opposed to the one end.

In like manner, a pair of first moveable contact members 8' and 9' along with a first fixed contact member 10' are arranged at the other lateral surface of the holder 7.

The first fixed contact members 10 and 10' are provided at free ends thereof with respective contacts **10*a*, 10*b*, and 10'*a*, 10'*b* formed on the respective upper and lower surfaces of these members. In positions corresponding to the positions of 10*a*, 10*b* and 10'*a*, 10'*b*, the first moveable contact members 8, 9 and 8', 9' are provided with respective contacts 8*a*, 9*a* and 8'*a*, 9'*a***.

Directly below respective free ends of the first moveable contact members 8, 9 and 8', 9', operating levers 11 and 11' are vertically supported on axial pins 12 and 12' fixed to the housing 1, respectively to swing about the pins 12 and 12' clockwise or anticlockwise.

At respective upper ends of the operating levers 11 and 11', extensions **11*a* and 11'*a* curved toward respective first moveable contact members 8, 9 and 8', 9' are formed. As operating levers 11 and 11' swing, the extensions 11*a* and 11'*a* are engaged with respective first moveable contact members 8, 9 and 8', 9' to enlarge respective gaps between the first moveable contact members, or are disengaged therefrom. Operating levers 11 and 11' are connected at respective lower ends thereof with respective one ends of compressive coil springs 14 and 14', respective other ends of which are supported on supports 13 and 13' fixed to the lower-middle portions of housing 1. Coil springs 14 and 14' urge respective operating levers 11 and 11' in opposing directions, such that extensions 11*a* and 11'*a* of respective operating levers 11 and 11'** swing outwardly, away from each other.

Operating levers 11 and 11' are provided at middle portions thereof with respective second moveable contact members 16 and 16' and respective second fixed contact members 17 and 17'. Each contact member has one end fixed to the corresponding operating lever and a free end opposed to the one end. Fixed ends of respective second moveable contact members 16, 16' and respective second fixed contact members 17, 17' are connected with respective terminals 20, 20', 21, and 21' by means of electric wires 18 and 19. The second moveable contact members 16, 16' and the second fixed contact members 17, 17' are provided at middle portions near free ends thereof with respective contacts 16*a*, 16'*a*, 17*a*, and 17'*a*. The second moveable contact members 16 and 16' have at free ends thereof contact heads 16*b* and 16'*b*, respectively. Free ends of respective second moveable contact members 16, 16' and respective second fixed contact members 17, 17' extend into the range of the radius of rotation of the above-mentioned timing cam 6, such that the timing cam 6 passes between second moveable contact members 16 and 16' and between second fixed contact members 17 and 17'.

Operating levers 11 and 11' are provided at lower portions thereof with contact rolls 15 and 15' protruded frontwardly, respectively. At either side of the timing cam 6, control cams 24 and 24' having peripheral surfaces forming involute curved surfaces are fixedly supported to axial rods 23 and 23' mounted rotatably on the housing 1, respectively. The control cams 24 and 24' are arranged to contact always with the contact rolls 15 and 15', respectively. Front ends of respective axial rods 23 and 23' extend frontwardly through the cover plate 2. Control knobs 22 and 22' are mounted on the front ends of axial rods 23 and 23', respectively.

As is apparent from FIG. 3, control cams 24 and 24' are urged toward the cover plate 2 by coil springs 25 and 25' disposed around axial rods 23 and 23', respectively. Control cams 24 and 24' have, at portions of front surfaces near respective apexes thereof, locking pins 26 and 26' frontwardly protruded, respectively. In positions corresponding to respective positions of the locking pins 26 and 26', locking holes 27 and 27' are formed on the inside surface of cover plate 2, in order to engage with the locking pins when the peripheral surface portions of respective apexes of control cams 24 and 24' reach the positions contacting with the contact rolls 15 and 15', respectively.

FIG. 7 shows an electric circuit of the electric power control switch according to the present invention, which circuit is designed to properly control electric power supplied to two electric loads.

In FIG. 7, reference numeral 29 designates a plug for connecting the present invention with an electric power source. One input line L1 of the plug 29 is connected to the first fixed contact members 10 and 10' having respective contacts 10*a*, 10*b* and 10'*a* and 10'*b*. Input line 11 is also connected to respective contact protrusions 16*a* and 16'*a* through terminals 20 and 20', respectively. The other input line L2 is connected to first movable contact members 9 and 9' having respective contacts 9*a* and, 9'*a* through indication lamps 30 and 30', respectively. Input line L2 is also connected to the second fixed contact members 17 and 17' having respective contacts 17*a* and 17'*a* through respective heater loads 28 and 28' and terminals 21 and 21', and is connected to the first movable contact members 8 and 8' having respective contacts 8*a* and 8'*a* through the motor M.

Timing cam 6 serves as means for connecting or disconnecting the reference contact protrusions 16*a*, 17*a* and /or 16'*a*, 17'*a* as it is withdrawn from or inserted between the corresponding contact members 16, 17 and/or 16', 17' based on its rotational position. Motor M for rotating cam 6 is activated when a pair of contacts 8*a*, 10*a* or 8'*a*, 10'*a* are closed, since it is connected in parallel to the contacts 8*a* and 8'*a*.

Hereinafter, the operation of the above-mentioned electric power control switch according to the present invention will be described.

As an operator rotates control knobs 22 and 22' mounted frontwardly on the cover plate 2 of the housing 1 in a clockwise or anti-clockwise, direction, axial rods 23 and 23' rotate, so that control cams 24 and 24' rotate clockwise or anti-clockwise, with peripheral surfaces thereof being in contact with respective contact rolls 15 and 15' of operating levers 11 and 11'. Thereby, operating levers 11 and 11' swing about axial pins 12 and 12', respectively.

When control cams 24 and 24' reach the positions at which apexes of the control cams 24 and 24' contact with respective contact rolls 15 and 15', locking pins 26 and 26' protruded from respective control cams 24 and 24' are engaged and locked in by locking holes 27 and 27', respectively. In this condition, operating levers 11 and 11' are vertically positioned, so that upper extensions 11*a* and 11'*a* of the operating levers are engaged with respective first moveable contact members 8, 9 and 8', 9' to enlarge the respective gaps between the first moveable contact members. Thereby, the contacts 8*a*, 9*a*, 8'*a*, 9'*a* and the corresponding contacts 10*a*, 10*b*, 10'*a*, 10'*b* are maintained in an opened condition, respectively. In this condition, the supply of current from the power source to the motor M and the loads 28 and 28' is prevented as shown in FIG. 7. Accordingly, the motor M and the loads 28 and 28' are not activated.

If it is required to supply current to one load 28 from the above-mentioned condition, then the operator manipulates the control knob 22 to rotate properly the control cam 24, thereby causing the operating lever 11 to swing about the axial pin 12 in anti-clockwise direction by the spring force of coil spring 14. Thereby, the extension 11*a* of operating lever 11 is disengaged from the first moveable contact members 8 and 9, so that the contact members 8 and 9 return to original positions at which contacts 8*a* and 9*a* contact with contacts 10*a* and 10*b*, respectively. In this condition, current from the power source is supplied via the plug 29 to the motor M and the indication lamp 30. Thereby, the motor M drives and the indication lamp 30 is illuminted.

As the motor M drives, the rotary shaft 5 rotates at a reduced rate by the reduction device 4, thereby causing the timing cam 6 to rotate at a constant rate.

In this condition, the timing cam 6 passes between the second moveable contact member 16 and the second fixed contact member 17, in view of the fact that respective free ends of the contact members extend into the rotation track of timing cam 6.

While the timing cam 6 passes between the second moveable contact member 16 and the second fixed contact member 17, the contact head 16*b* of the second moveable contact member 16 rides on the surface of timing cam 6, thereby causing the second moveable contact member 16 to be curved by the thickness of timing cam 6. As a result, the contact 16*a* is separated from the contact 17*a*, so that the supply of current from the power source to the load 28 is prevented.

When the timing cam 6 escapes from the contact members 16 and 17, the moveable contact member 16 returns to its original position by virtue of elastic force. Thereby, the contact 16*a* contacts again with the contact 17*a* to supply current from the power source to the load 28.

Thus, the contacts 16*a* and 17*a* repeat opened and closed conditions thereof for a certain period, as the timing cam 6 continuously rotates. Accordingly, current is repeatedly supplied to the load 28 at certain intervals predetermined by the timing cam 6, so that the load 28 can be heated while being maintained at a constant temperature.

Although the operation has been described hereinbefore with respect to the heating condition of only one load 28, the other load 28' may be heated to a certain temperature by an identical operation effected by the manipulation of control knob 22'.

The period of repeating ON and OFF conditions of the switch can be easily controlled, by setting the control cams 24 and 24' at desired positions by the operator.

If the control cams 24 and 24' are set such that the contact heads 16*b* and 16'*b* of respective second moveable contact members 16 and 16' are positioned near the central portion of timing cam, the period during which the timing cam 6 contacts with the contact heads 16*b* and 16'*b* is long, thereby causing the opened period of contacts 16*a*, 16'*a* and 17*a*, 17'*a* to be long and the period supplying currents to the loads to be short. Thereby, the applied electric power is reduced due to the long period of preventing the supply of currents.

As different from the above-mentioned condition, when the control cams 24 and 24' are set such that the contact heads 16*b* and 16'*b* of respective second moveable contact members 16 and 16' are positioned away from the central portion of timing cam, the period during which the timing cam 6 contacts with the contact heads 16*b* and 16'*b* is short, thereby causing the opened period of contacts 16*a*, 16'*a* and 17*a*, 17'*a* to be long and the period supplying currents to the loads to be long. Thereby, the applied electric power is increased due to the short period of preventing the supply of current.

On the other hand, when the control cams 24 and 24' are set such that the contact heads 16*b* and 16'*b* of respective second moveable contact members 16 and 16' escape from the rotation track of timing cam 6, the contacts 16*a*, 16'*a* and 17*a*, 17'*a* are maintained in a closed condition, irrespective of the rotation of timing cam 6. Thereby, currents are continuously supplied to the load 28 and 28'.

Although the timing cam 6 is illustrated and described to comprise a rectangular plate in the above-mentioned embodiment, the shape and construction of timing cam can be varied in order to vary the period of opening and closing contacts 16*a*, 16'*a* of the second moveable contact members 16, 16' and contacts 17*a*, 17'*a* of the second fixed contact members 17, 17'.

FIGS. 6A–6H are respective front and cross-sectional views showing different examples of timing cams capable of being applied to the present invention.

The timing cam 6*a* shown in FIG. 6A comprises a disc with uniform thickness and diameter. The disc is provided at the center thereof with an axial hole 62 and at the front surface thereof with an arc cam groove 61. As the timing cam 6*a* rotates, contact heads 16*b* and 16'*b* of the second moveable contact members 16 and 16' always contact with front surfaces of the timing cam 6*a*. When the contact heads 16*b* and 16'*b* are inserted into the cam groove 61, contacts 16*a* and 16'*a* of the second moveable contact members 16 and 16' contact with contacts 17*a* and 17'*a* of the second fixed contact members 17 and 17', respectively. When the contact heads 16*b* and 16'*b* escape from the cam groove 61, contacts 16*a* and 16'*a* separate from contacts 17*a* and 17'*a*, respectively. Thus, contacts 16*a*, 16'*a* and contacts 17*a*, 17'*a* are repeatedly closed and opened for certain intervals, as the timing cam 6*a* rotates.

The timing cam 6*c* shown in FIG. 6C comprises a disc of another construction, in which at either side of the axial hole 62, two cam groovs 63 are symmetrically formed on the front surface of disc. The function of timing cam 6*c* is similar to that of timing cam 6*a*.

The timing cam 6*c* shown in FIG. 6E comprises a disc of another construction in which a cam groove 64 is formed on the front surface of disc around the axial hole 62. The function of timing cam 6*e* is also similar to that of timing cam 6*a*.

The timing cam 6*g* shown in FIG. 6G comprises a star-shaped plate in which several triangular blades 65 are formed around the axial hole 62 and are spaced with a uniform distance. When contact heads 16*b* and 16'*b* of the second moveable contact members 16 and 16' ride on either one of the triangular blades 65, contacts 16*a* and 16'*a* and contacts 17*a* and 17'*a* are maintained at the opened condition thereof. When contact heads 16*b* and 16'*b* are positioned between adjacent blades 65, contacts 16*a*, 16'*a* and contacts 17*a*, 17'*a* are maintained at the closed condition thereof.

As apparent from the above-mentioned description, the electric power control switch of present invention in which contacts are repeatedly closed and opened for certain intervals by means of one timing cam driven by a motor and two control cams is characterized in that a timing cam passes between two contact members disposed in parallel with each other and spaced at a certain distance in order to close and open contacts of the contact members. In this arrangement, contacts can be opened and closed in a moment, thereby causing the generation of spark and thus the wearing of contacts to be reduced. Because closing and opening of contacts can be accurately effected without overload applied to be contact members, the elastic fatigue of moveable contact members can be reduced, thereby enabling the life of contact members to be lengthened. Accordingly, the switch of present invention is highly reliable, in that there is no variation of the period of closing and opening switch, caused by the wearing of contacts, even after long period of usage.

What is claimed is:

1. An electric power control switch, comprising:

a switch housing;

a timing cam formed of an electrically non-conductive material and driven by a motor with a rotary shaft coupled to a motor attached to the rear side of said housing;

a first switch means transversely disposed inside said housing and on the upper portion of said housing, comprising two sets of switch members which extend against each other, each set comprising an upper and a lower movable contact member and a middle fixed contact member, said upper and lower movable contact members having a contact on their lower and upper sides, respectively, said middle fixed contact member having contacts on both its upper and lower sides, the contact of said upper movable contact member, when positioned in electrical connection with the contact on the upper side of said middle fixed contact member, serving to complete a first electrical circuit path to activate said motor, the contact of said lower movable contact member, when positioned in electrical connection with the contact on the lower side of said middle fixed contact member, serving to complete a second electrical circuit path to activate an indication lamp;

a pair of operating levers which vertically disposed in cooperating relationship with said switch members and which, when positioned between said movable contact members, serve to disconnect said contacts from one another and which, when withdrawn from between said movable contact members, serve to connect said contacts to one another;

a pair of control cams each provided with a generally involute curvature profile, disposed in cooperating relationship with said operating levers, the rotational position of said control cams causing said respective operating lever to either be positioned between or withdrawn from said respective movable contact members, said rotational position being adjusted by means of a control knob affixed to each of said control cams; and a second switch means having two pairs of switch elements, each pair comprising a second movable contact member and a second fixed contact member, the first ends of which are affixed to said operating lever, the other ends of which are free, each of said second movable and second fixed contact members having a contact protrusion on the inner portion thereof, each of said free ends extending so as to be within the range of the radius of rotation of said timing cam, said contact protrusions of said free ends being connected or disconnected from each other according to whether said timing cam is positioned between or withdrawn from said respective second movable and second fixed contact members as said timing cam is rotated by said motor.

2. An electric power control switch as set forth in claim 1, wherein said operating lever is pivotally secured to the rear of said housing with an axial pin, and is provided with an upper end curved toward said switch members and a lower end biased by a coil spring affixed to the rear of said housing, and is further provided with a contact roll which abuts against the edge of said control cam and causes said operating lever to pivot about said axial pin as said control cam is rotated.

3. An electric power control switch as set forth in claim 1, wherein said second movable and second fixed contact members are spaced from each other, and said second movable contact member is further provided with a contact head which, when contacted by said timing cam, causes said second movable contact member to bend and separate said contact protrusions from each other.

4. An electric power control switch as set forth in claim 1, wherein said timing cam has a generally rectangular profile and has a thickness corresponding to the spacing between said second movable and second fixed contact members.

5. An electric power control switch as set forth in claim 1, wherein said timing cam has a disk profile and is formed with a crescent-shaped cam groove on one surface, and has a thickness corresponding to the spacing between said second movable and second fixed contact members.

6. An electric power control switch as set forth in claim 1, wherein said timing cam has a disk profile and is formed with a pair of generally half-moon shaped cam grooves on one surface, and has a thickness corresponding to the spacing between said second movable and second fixed contact members.

7. An electric power control switch as set forth in claim 1, wherein said timing cam has a disk profile and is formed with a generally elliptical annular cam groove around an axial hole on one surface, and has a thickness corresponding to the spacing between said second movable and second fixed contact members.

8. An electric power control switch as set forth in claim 1, wherein said timing cam has a generally star-shaped profile having several identical triangular cam blades.

* * * * *